US008850932B2

(12) United States Patent
Tsai

(10) Patent No.: US 8,850,932 B2
(45) Date of Patent: Oct. 7, 2014

(54) POSITIONING DEVICE FOR A HAND TOOL

(71) Applicant: Ming-Ching Tsai, Taichung (TW)

(72) Inventor: Ming-Ching Tsai, Taichung (TW)

( * ) Notice: Subject to any disclaimer, the term of this patent is extended or adjusted under 35 U.S.C. 154(b) by 244 days.

(21) Appl. No.: 13/646,730

(22) Filed: Oct. 7, 2012

(65) Prior Publication Data

US 2013/0283984 A1 Oct. 31, 2013

(30) Foreign Application Priority Data

Apr. 27, 2012 (TW) ..... 101207980 A

(51) Int. Cl.
*B25B 23/16* (2006.01)

(52) U.S. Cl.
USPC ..... 81/177.8; 81/177.9; 81/177.7

(58) Field of Classification Search
USPC ..... 81/177.8, 177.9, 177.7
See application file for complete search history.

(56) References Cited

U.S. PATENT DOCUMENTS

| | | | | |
|---|---|---|---|---|
| 6,000,302 | A * | 12/1999 | Chiang | 81/177.8 |
| 7,841,262 | B1 * | 11/2010 | Tsai | 81/177.9 |
| 8,671,809 | B1 * | 3/2014 | Chen | 81/177.8 |
| 2004/0177731 | A1 * | 9/2004 | Chen | 81/177.8 |

* cited by examiner

*Primary Examiner* — Hadi Shakeri

(57) ABSTRACT

A positioning device for a hand tool includes a handle, a tool head, a positioning member and an adjusting member. The positioning member has a pusher and a spring. The adjusting member has a threaded portion1 extended therefrom and abutted against the pusher. An extending portion is extended from the threaded portion. A retaining portion is defined at one end of the extending portion. Therefore, when a user rotates the adjusting member, the retaining portion is restricted by the pusher for preventing the adjusting member being lost.

8 Claims, 8 Drawing Sheets

POSITIONING DEVICE FOR A HAND TOOL

BACKGROUND OF THE INVENTION

1. Field of the Invention

The present invention relates to a hand tool, and more particularly to a positioning device for a hand tool.

2. Description of Related Art

A conventional positioning device for a hand tool comprises a handle, a tool head, a positioning member, and a rotatable plate. The handle has a connecting portion and the tool head is pivotally connected to the connecting portion. The connecting portion has a threaded hole defined therethrough. The tool head has a plurality of second teeth defined at one end thereof. The positioning member comprises a pusher which has a plurality of first teeth defined thereon and a spring which abuts against the pusher. The first teeth of the pusher engage with the second teeth of the head for limiting the pivotal movement of the tool head relative to the handle. The rotatable plate has a threaded shank extended therefrom. The threaded shank passes through the threaded hole of the connecting portion to push the pusher for locking the tool head. When the rotatable plate is rotated, the threaded shank moves outwardly away from the pusher, and the pusher disengages with the tool head. Therefore, the tool head is pivotally adjustable in a desired angle relative to the handle.

However, the conventional positioning device for the hand tool has a disadvantage in an operating state. When a user rotates the rotatable plate reversely, the threaded shank moves outwardly away from the pusher. Under this arrangement, the rotatable plate is easily lost if the user rotates the rotatable plate overly, as a result, the user needs to reinstall the rotatable plate into the threaded hole. Therefore, the conventional positioning device of the hand tool is inconvenient to be used.

The present invention has arisen to mitigate and/or obviate the disadvantages of the conventional positioning device for a hand tool.

SUMMARY OF THE INVENTION

The main objective of the present invention is to provide an improved positioning device for a hand tool.

To achieve the objective, a positioning device for a hand tool comprises a handle, a tool head, a positioning member and an adjusting is member, the handle having a groove defined at one end thereof; two first through holes respectively and coaxially opened at two opposite lateral surfaces of the groove, the groove having a chamber defined at a bottom thereof; the handle having a threaded hole defined in a lateral side thereof and communicated with the chamber, the tool head having a connecting portion extended therefrom and mounted in the groove of the handle, the connecting portion having a second through hole opened in a center thereof and corresponding to the first through holes, a pin passed through the first through holes and the second through hole, the connecting portion having a plurality of second teeth defined on a periphery of a bottom of the connecting portion and extended toward the chamber, the positioning member received in the chamber, the positioning member having a pusher and a spring, the pusher having a plurality of first teeth formed at one end thereof and engaged with the second teeth of the tool head, the pusher having a shank formed at another end thereof, the spring sleeving onto the shank, one end of the spring abutted against a bottom of the chamber, and the adjusting member having a threaded portion extended therefrom and abutted against the shank of the pusher, an extending portion extended from the threaded portion toward the chamber, a retaining portion defined at one end of the extending portion, one end of the shank extended to the extending portion and located between the threaded portion and the retaining portion. Wherein the threaded portion of the adjusting member has an inclined surface defined at one end thereof; the shank of the pusher has a conical end defined on a bottom of the shank and abutted against the inclined surface; the chamber is divided into two parts; one end of the spring is abutted against a bottom of an upper portion of the chamber; a lower portion of the chamber has a notch defined therein and corresponding to the threaded hole, and the retaining portion of the adjusting member is movable in the lower portion of the chamber; a diameter of the extending portion of the adjusting member is smaller than another diameter of the threaded portion and the other diameter of the retaining portion; the adjusting member has a rotatable plate defined out of the threaded hole; the rotatable plate has a plurality of axial slots defined on an outer periphery of the rotatable plate.

A positioning device for a hand tool comprises a handle, a tool head, a positioning member and an adjusting member, the handle having a groove defined at one end thereof, two first through holes respectively and coaxially opened at two opposite lateral surfaces of the groove, the groove having a chamber defined at a bottom thereof, the handle having a threaded hole defined in a lateral side thereof and communicated with the chamber, the tool head having a connecting portion extended therefrom and mounted in the groove of the handle, the connecting portion having a second through hole opened in a center thereof and corresponding to the first through holes, a pin passed through the first through holes and the second through hole, the connecting portion having a plurality of second teeth defined on a periphery of a bottom of the connecting portion and extended toward the chamber, the positioning member received in the chamber, the positioning member having a pusher and a spring, the pusher having a plurality of first teeth formed at one end thereof and engaged with the second teeth of the tool head, the pusher having a receiving space defined in another end thereof and a spring received in the receiving space, one end of the spring abutted against the bottom of the receiving space, another end of the spring extended out of the receiving space, and the adjusting member having a threaded portion extended therefrom and abutted against the pusher, an extending portion extended from the threaded portion toward the chamber, a retaining portion defined at one end of the extending portion, one end of the spring which is extended out of the receiving space abutting against the extending portion and located between the threaded portion and the retaining portion. Wherein the threaded portion of the adjusting member has an inclined surface defined at one end thereof; the pusher has an inclined edge defined on the bottom thereof and abutted against the inclined surface of the threaded portion; the chamber has a notch defined therein and corresponding to the threaded hole, and the retaining portion of the adjusting member is movable in the notch; the adjusting member has a rotatable plate defined out of the threaded hole; the rotatable plate has a plurality of axial slots defined on an outer periphery of the rotatable plate.

Further benefits and advantages of the present invention will become apparent after a careful reading of the detailed description with appropriate reference to the accompanying drawings.

DETAILED DESCRIPTION OF THE INVENTION

Figure 1:
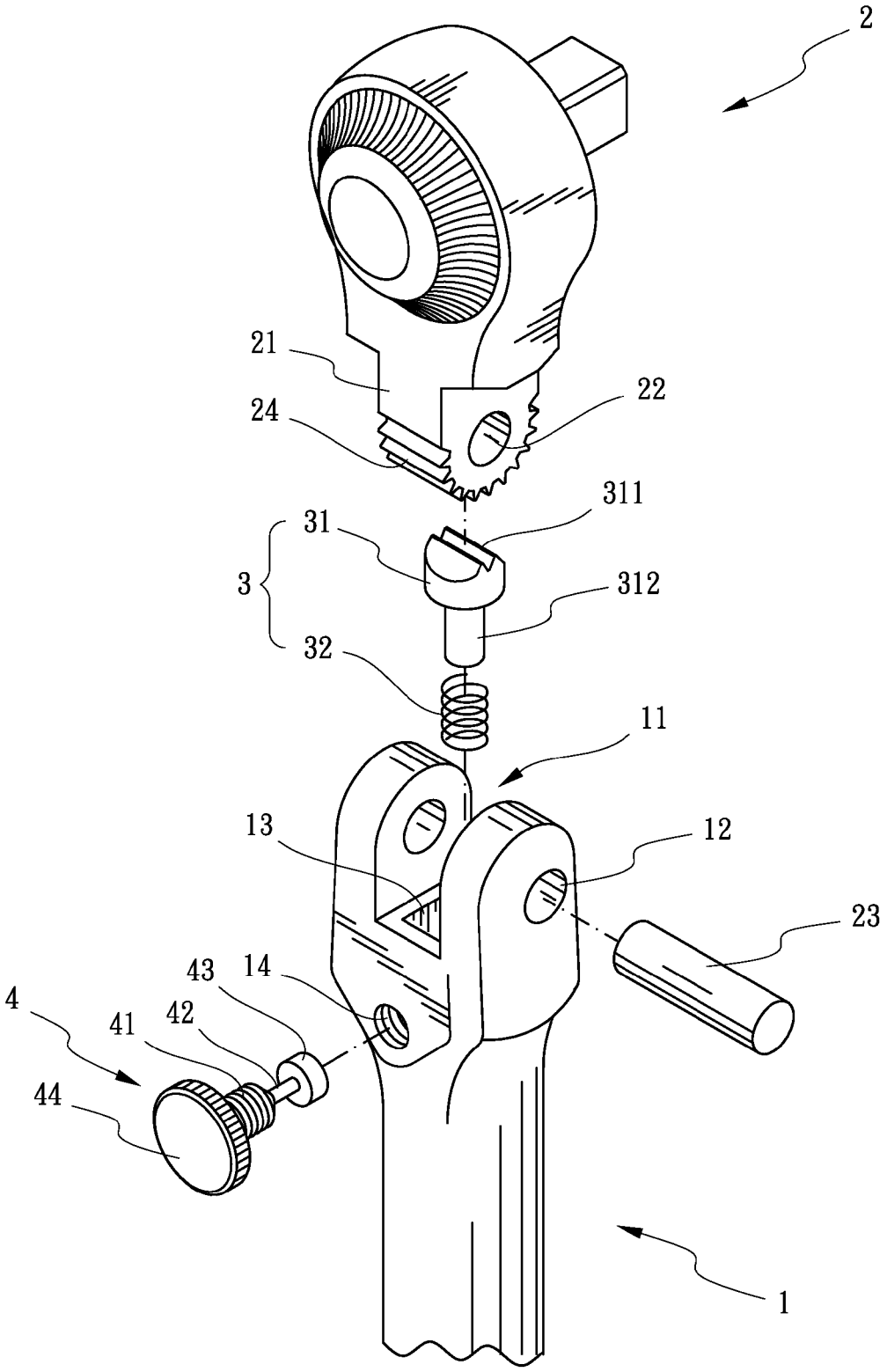
FIG. 1 is an exploded perspective view of a first embodiment of a positioning device for a hand tool of the present invention.

Referring to FIGS. 1-4, a positioning device for a hand tool in accordance with a first embodiment of the present invention comprises a handle 1, a tool head 2, a positioning member 3 and an adjusting member 4.

The handle 1 has a groove 11 defined at one end thereof, and two first through holes 12 are respectively and coaxially opened at two opposite lateral surfaces of the groove 11. The groove 11 has a chamber 13 defined at a bottom thereof. The handle 1 has a threaded hole 14 defined in a lateral side thereof and communicated with the chamber 13.

The tool head 2 has a connecting portion 21 extended therefrom and mounted in the groove 11 of the handle 1. The connecting portion 21 has a second through hole 22 opened in a center thereof and corresponding to the first through holes 12. A pin 23 is passed through the first through holes 12 and the second through hole 22 for pivotally connecting the tool head 2 with the handle 1. The connecting portion 21 has a plurality of second teeth 24 defined on a periphery of a bottom of the connecting portion 21 and extended toward the chamber 13.

The positioning member 3 is movably received in the chamber 13. The positioning member 3 comprises a pusher 31 and a spring 32. The pusher 31 has a plurality of first teeth 311 formed at one end thereof and engaged with the second teeth 24 of the tool head 2. The pusher 31 has a shank 312 formed at another end thereof. The spring 32 sleeves onto the shank 312. One end of the spring 31 is abutted against a bottom of the chamber 13.

The adjusting member 4 has a threaded portion 41 extended therefrom. The threaded portion 41 is inwardly or outwardly screwed into the threaded hole 14 and is abutted against the shank 312 of the pusher 31. An extending portion 42 is extended from the threaded portion 41 toward the chamber 13. A retaining portion 43 is defined at one end of the extending portion 42. One end of the shank 312 is extended to the extending portion 42 and is located between the threaded portion 41 and the retaining portion 42.

Figure 2:
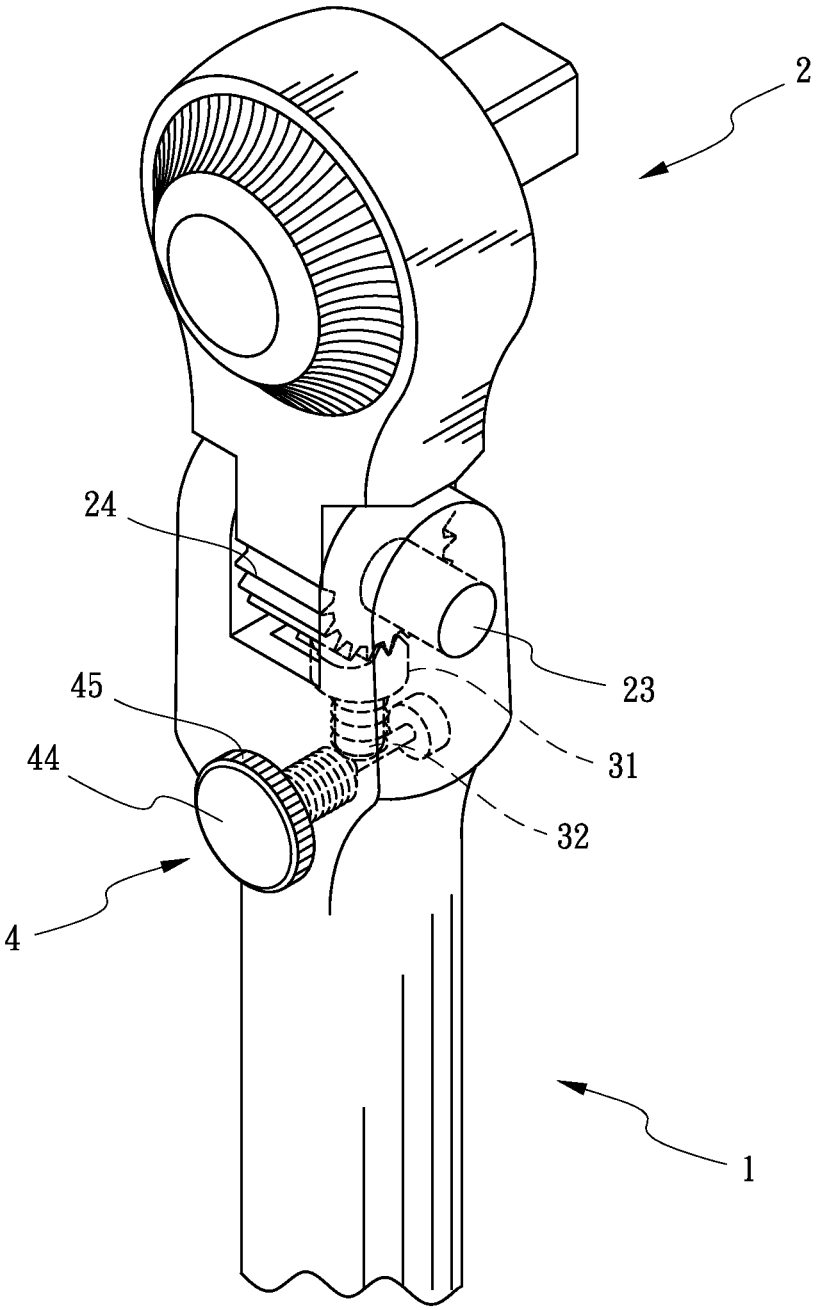
FIG. 2 is a perspective view of the first embodiment of the positioning device for a hand tool.
Figure 3:
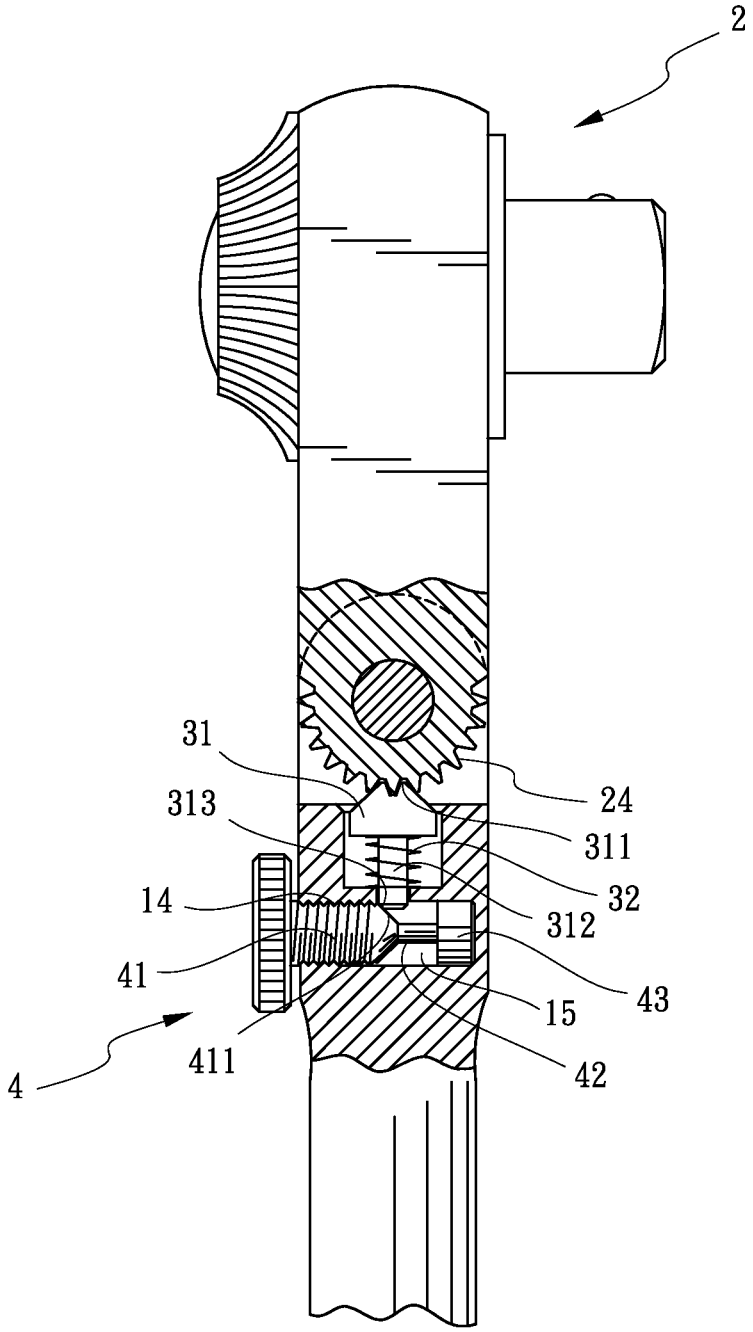
FIG. 3 is a partial cross-sectional view of the first embodiment of the positioning device for a hand tool for showing an adjusting member is abutted against a pusher and a tool head is locked at a certain angle.
Figure 4:
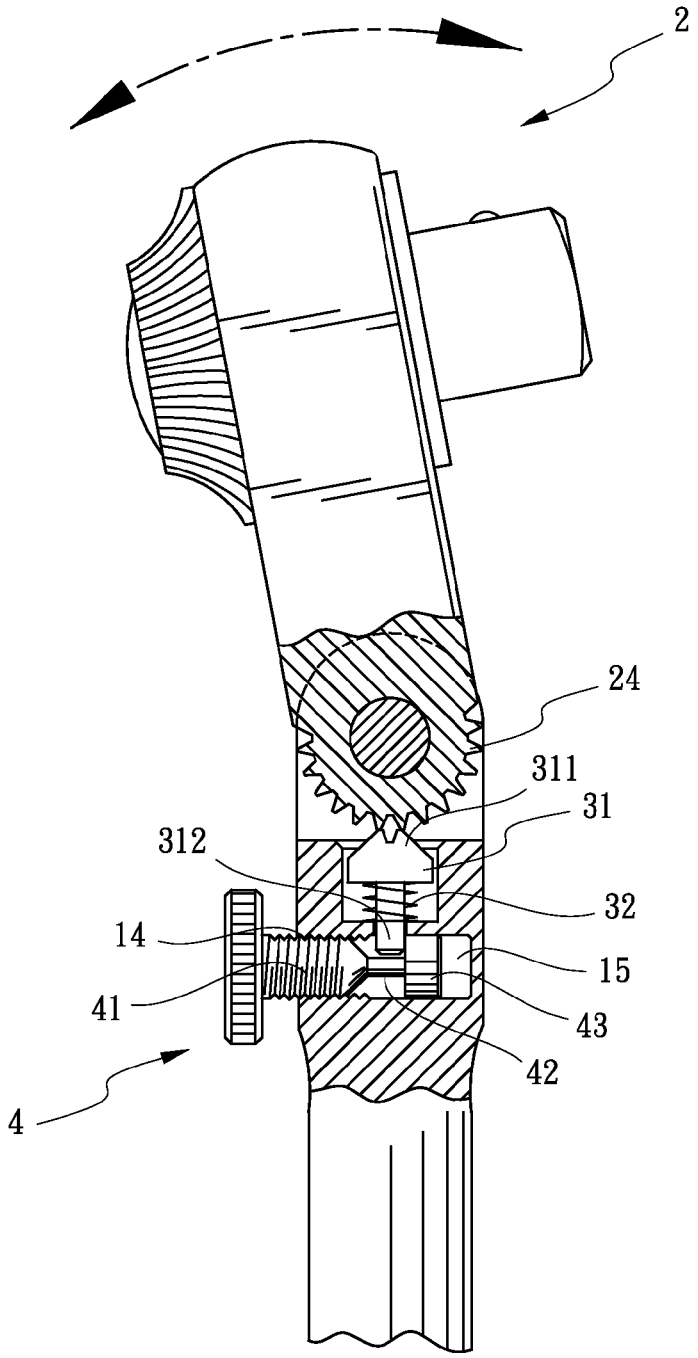
FIG. 4 is a partial cross-sectional view of the first embodiment of the positioning device for a hand tool for showing the adjusting member is moved outwardly and the tool head is pivotally rotatable.
Figure 5:
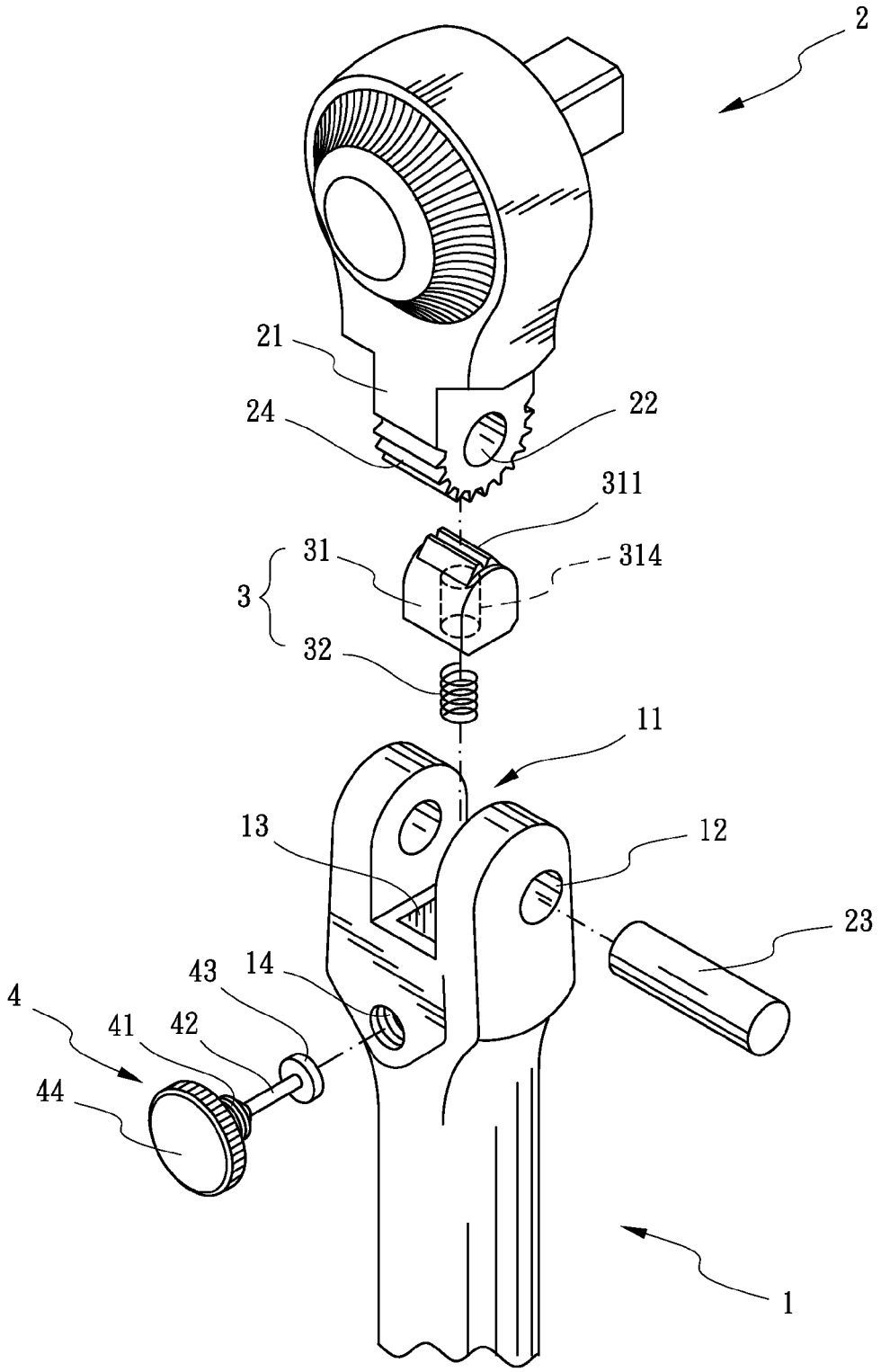
FIG. 5 is an exploded perspective view of a second embodiment of a positioning device for a hand tool.
Figure 6:
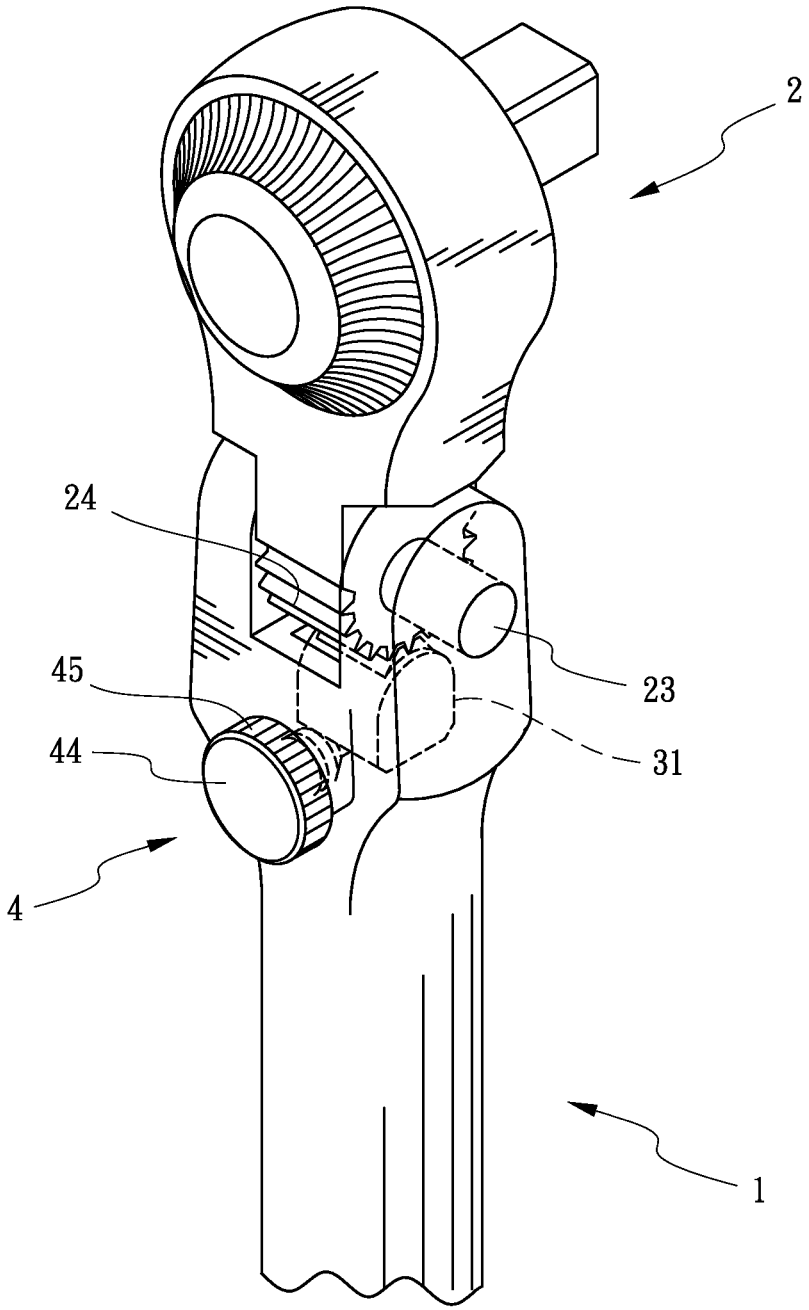
FIG. 6 is a perspective view of the second embodiment of the positioning device for a hand tool.
Figure 7:
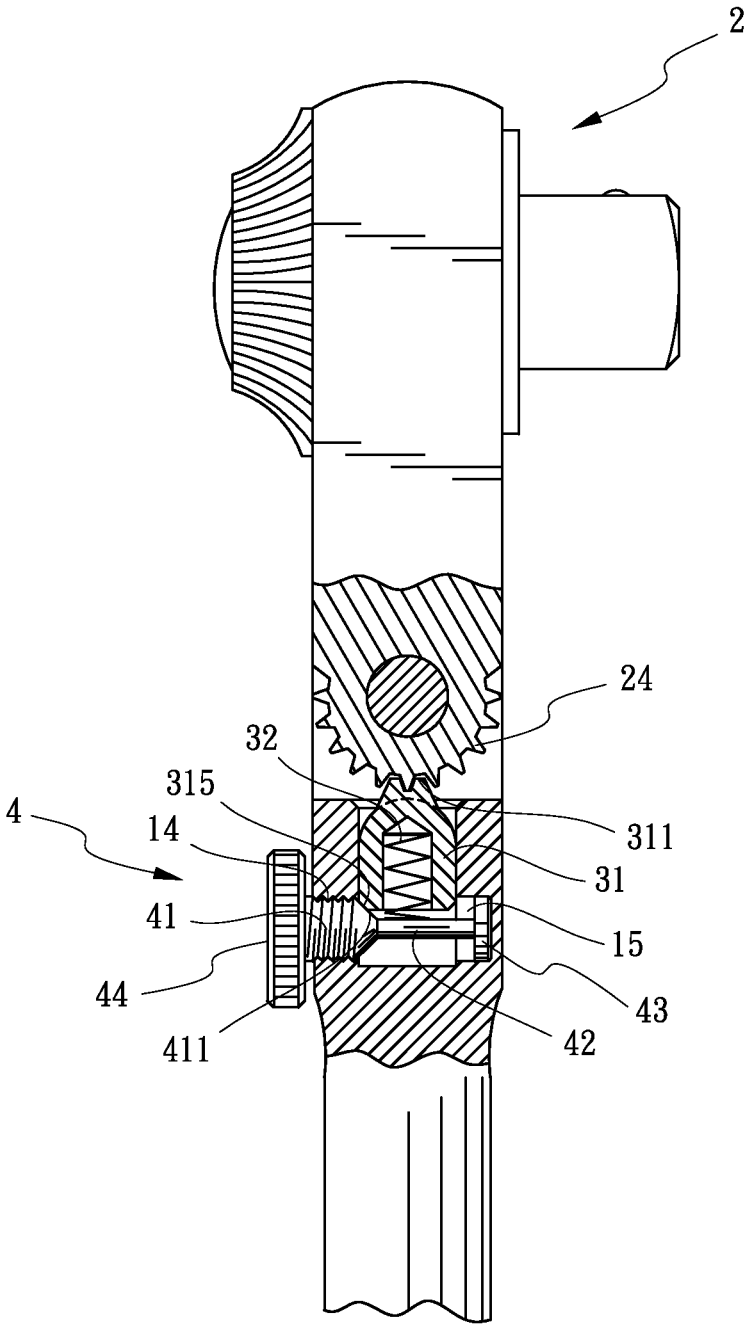
FIG. 7 is a partial cross-sectional view of the second embodiment of the positioning device for a hand tool for showing an adjusting member is abutted against a pusher and a tool head is locked at a certain angle.
Figure 8:
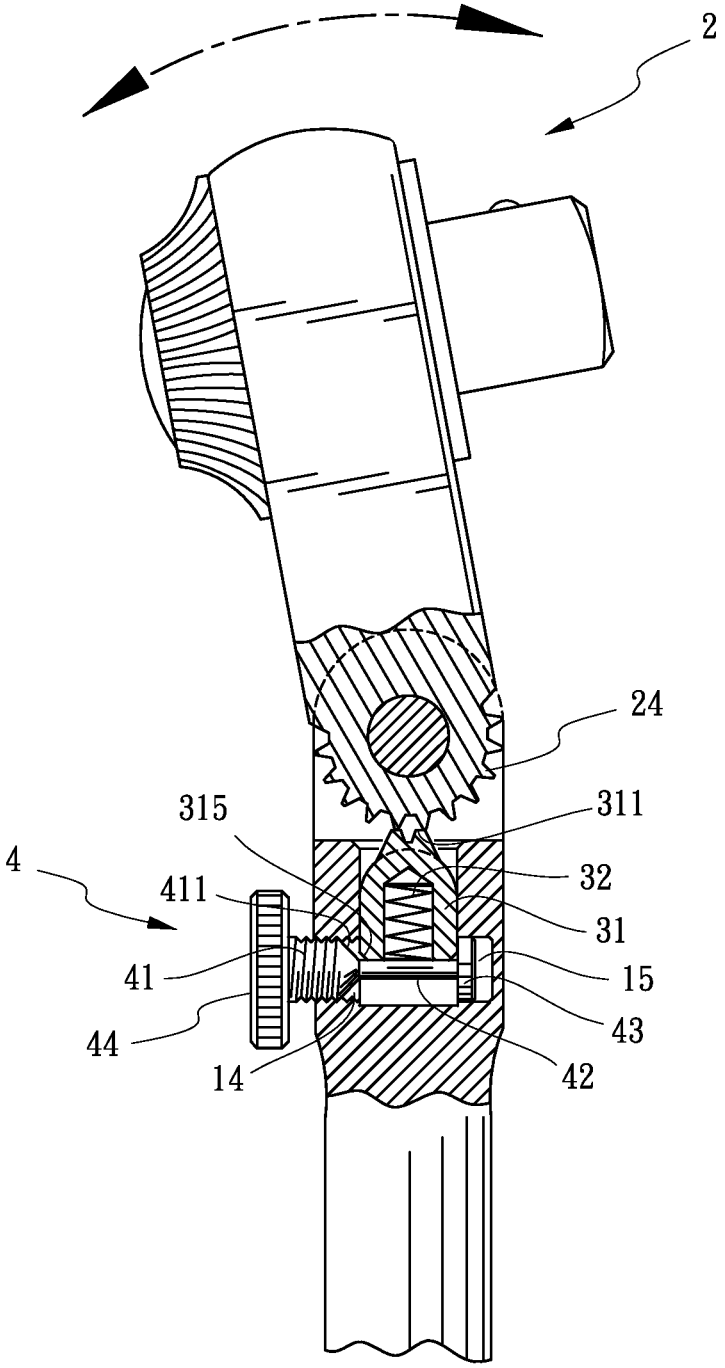
FIG. 8 is a partial cross-sectional view of the second embodiment of the positioning device for a hand tool for showing the adjusting member is moved outwardly and the tool head is pivotally rotatable.

The operation of the positioning device for a hand tool accordance with the first embodiment of the present invention is shown in FIGS. 2-4. When a user rotates the adjusting member 4 inwardly, one end of the threaded portion 41 is moved inwardly to abut against an edge of the shank 312 of the pusher 31 and the spring 32 pushes the pusher 31, so that the first teeth 311 of the pusher 31 engage with the second teeth 24 of the tool head 2. Therefore, the tool head 2 is locked stably relative to the handle 1.

In contrast, when a user rotates the adjusting member 4 outwardly, the threaded portion 41 is moved outwardly away from the shank 312 of the pusher 31 so that the first teeth 311 of the pusher 31 disengage with the second teeth 24 of the tool head 2. Therefore, the tool head 2 could be pivotally rotated in a certain angle relative to the handle 1. When the tool head 2 is pivotally rotated, the first teeth 311 of the pusher 31 are disengaged with the second teeth 24 of the tool head 2 step by step because the spring 32 is compressingly abutted against the pusher 31 toward the tool head 2, so that the pusher 31 is moved up and down in the chamber 13. When the user continues to rotate the adjusting member 4 outwardly, the retaining portion 43 is restricted by the shank 312 of the pusher 31 so that the adjusting member 4 is unable to rotate continuously because an inner surface of the retaining portion 43 is abutted against one end of the shank 312 of the pusher 31.

Under this arrangement, when a user rotates the adjusting member 4, the retaining portion 43 is restricted by the shank 312 of the pusher 31 to restrict the adjusting member 4 for preventing the adjusting member 4 being lost.

The threaded portion 41 of the adjusting member 4 further has an inclined surface 411 defined at one end thereof. The shank 312 of the pusher 31 has a conical end 313 defined on a bottom of the shank 312 and abutted against the inclined surface 411. Therefore, the adjusting member 4 and the shank 312 of the pusher 31 have a larger contact area between each other because of the inclined surface 411 and the conical end 313.

A diameter of the extending portion 42 of the adjusting member 4 is smaller than another diameter of the threaded portion 41 and the other diameter of the retaining portion 43. The adjusting member 4 has a rotatable plate 44 formed as a round shape and formed at one end thereof. The rotatable plate 44 is defined out of the threaded hole 14. The rotatable plate 44 has a plurality of axial slots 45 defined on an outer periphery of the rotatable plate 44 so that the user could operate the rotatable plate 44 stably.

The chamber 13 is further divided into two parts. One end of the spring 32 is abutted against a bottom of an upper portion of the chamber 13. A lower portion of the chamber 13 has a notch 15 defined therein and corresponding to the threaded hole 14, and the retaining portion 43 of the adjusting member 4 is movable in the lower portion of the chamber 13.

FIGS. 5-8 show a second embodiment of the present invention (only the differences between the first embodiment and the second embodiment are described below). A pusher 31 has a plurality of first teeth 311 formed at one end thereof and engaged with the second teeth 24 of the tool head 2. The pusher 31 has a receiving space 314 defined in another end thereof and a spring 32 compressingly received in the receiving space 314. One end of the spring 32 is abutted against the bottom of the receiving space 314; another end of the spring 32 is extended out of the receiving space 314 and abuts against the extending portion 42 and is located between the threaded portion 41 and the retaining portion 43.

Under this arrangement, when a user rotates the adjusting member 4 inwardly, one end of the threaded portion 41 is moved inwardly to abut against an edge of the pusher 31, and the spring 32 pushes the pusher 31, so that the first teeth 311 of the pusher 31 engage with the second teeth 24 of the tool head 2. Therefore, the tool head 2 is locked stably relative to the handle 1.

In contrast, when the user rotates the adjusting member 4 outwardly, the threaded portion 41 is moved outwardly away from the pusher 31 so that the first teeth 311 of the pusher 31 disengage with the second teeth 24 of the tool head 2. Therefore, the tool head 2 could be pivotally rotated in a certain angle relative to the handle 1. When the tool head 2 is pivotally rotated, the first teeth 311 of the pusher 31 are disengaged with the second teeth 24 of the tool head 2 step by step because the spring 32 is compressingly abutted against the pusher 31 toward the tool head 2, so that the pusher 31 is moved up and down in the chamber 13. When the user continues to rotate the adjusting member 4 outwardly, the retaining portion 43 is restricted by the shank 312 of the pusher 31 so that the adjusting member 4 is unable to rotate continuously because an inner surface of the retaining portion 43 is abutted against the end of the shank 312 of the pusher 31 (refer to the former paragraph).

The pusher 31 further has an inclined edge 315 defined on the bottom thereof and abutted against the inclined surface 411 of the threaded portion 41.

Although the invention has been explained in relation to its preferred embodiment, it is to be understood that many other possible modifications and variations can be made without departing from the spirit and scope of the invention as hereinafter claimed.

What is claimed is:

1. A positioning device for a hand tool comprising:

a handle, a tool head, a positioning member and an adjusting member;

the handle having a groove defined at one end thereof, two first through holes respectively and coaxially opened at two opposite lateral surfaces of the groove, the groove having a chamber defined at a bottom thereof, the handle having a threaded hole defined in a lateral side thereof and communicated with the chamber;

the tool head having a connecting portion extended therefrom and mounted in the groove of the handle, the connecting portion having a second through hole opened in a center thereof and corresponding to the first through holes, a pin passed through the first through holes and the second through hole, the connecting portion having a plurality of second teeth defined on a periphery of a bottom of the connecting portion and extended toward the chamber;

the positioning member received in the chamber, the positioning member having a pusher and a spring, the pusher having a plurality of first teeth formed at one end thereof and engaged with the second teeth of the tool head, the pusher having a shank formed at another end thereof, the spring sleeving onto the shank, one end of the spring abutted against a bottom of the chamber; and the adjusting member having a threaded portion extended therefrom and abutted against the shank of the pusher, an extending portion extended from the threaded portion toward the chamber, a retaining portion defined at one end of the extending portion, one end of the shank extended to the extending portion and located between the threaded portion and the retaining portion.

2. The positioning device for a hand tool as claimed in claim 1, wherein the threaded portion of the adjusting member has an inclined surface defined at one end thereof; the shank of the pusher has a conical end defined on a bottom of the shank and abutted against the inclined surface.

3. The positioning device for a hand tool as claimed in claim 1, wherein the chamber is divided into two parts; one end of the spring is abutted against a bottom of an upper portion of the chamber; a lower portion of the chamber has a notch defined therein and corresponding to the threaded hole, and the retaining portion of the adjusting member is movable in the lower portion of the chamber.

4. The positioning device for a hand tool as claimed in claim 1, wherein a diameter of the extending portion of the adjusting member is smaller than a diameter of the threaded portion and a diameter of the retaining portion; the adjusting member has a rotatable plate defined out of the threaded hole; the rotatable plate has a plurality of axial slots defined on an outer periphery of the rotatable plate.

5. A positioning device for a hand tool comprising:

a handle, a tool head, a positioning member and an adjusting member;

the handle having a groove defined at one end thereof, two first through holes respectively and coaxially opened at two opposite lateral surfaces of the groove, the groove having a chamber defined at a bottom thereof, the handle having a threaded hole defined in a lateral side thereof and communicated with the chamber;

the tool head having a connecting portion extended therefrom and mounted in the groove of the handle, the connecting portion having a second through hole opened in a center thereof and corresponding to the first through holes, a pin passed through the first through holes and the second through hole, the connecting portion having a plurality of second teeth defined on a periphery of a bottom of the connecting portion and extended toward the chamber;

the positioning member received in the chamber, the positioning member having a pusher and a spring, the pusher having a plurality of first teeth formed at one end thereof and engaged with the second teeth of the tool head, the pusher having a receiving space defined in another end thereof and the spring received in the receiving space, one end of the spring abutted against the bottom of the receiving space, another end of the spring extended out of the receiving space; and the adjusting member having a threaded portion extended therefrom and abutted against the pusher, an extending portion extended from the threaded portion toward the chamber, a retaining portion defined at one end of the extending portion, one end of the spring which is extended out of the receiving space abutting against the extending portion and located between the threaded portion and the retaining portion.

6. The positioning device for a hand tool as claimed in claim 5, wherein the threaded portion of the adjusting member has an inclined surface defined at one end thereof; the pusher has an inclined edge defined on the bottom thereof and abutted against the inclined surface of the threaded portion.

7. The positioning device for a hand tool as claimed in claim 5, wherein the chamber has a notch defined therein and corresponding to the threaded hole, and the retaining portion of the adjusting member is movable in the notch.

8. The positioning device for a hand tool as claimed in claim 5, wherein the adjusting member has a rotatable plate defined out of the threaded hole; the rotatable plate has a plurality of axial slots defined on an outer periphery of the rotatable plate.

* * * * *